US005323217A

United States Patent [19]

Christy et al.

[11] Patent Number: 5,323,217

[45] Date of Patent: Jun. 21, 1994

[54] ION DEPOSITION PRINTER CLEANING APPARATUS AND RELATED METHOD

[75] Inventors: Orrin Christy, N. Tonawanda; John E. Pickett, E. Amherst; Mark A. Matheis, N. Tonawanda; James R. Halliday, Lewiston; Michael D. Akins, N. Tonawanda, all of N.Y.

[73] Assignee: Moore Business Forms, Inc., Grand Island, N.Y.

[21] Appl. No.: 35,157

[22] Filed: Mar. 22, 1993

[51] Int. Cl.[5] ..... G03G 21/00

[52] U.S. Cl. ..... 355/297; 15/256.51; 118/652; 355/296; 355/298; 355/299

[58] Field of Search ..... 355/296-300; 118/652; 15/256.51

[56] References Cited

U.S. PATENT DOCUMENTS

| | | | |
|---|---|---|---|
| 3,099,856 | 8/1963 | Eichorn et al. | 15/256.51 |
| 3,625,605 | 12/1971 | Schnall et al. | 355/300 |
| 3,725,059 | 4/1973 | Komp | 118/652 X |
| 3,792,925 | 2/1974 | Milligan et al. | 355/300 |
| 3,796,183 | 3/1974 | Thettu | 118/70 |
| 3,862,801 | 1/1975 | Komp | 355/307 X |
| 3,947,108 | 3/1976 | Thettu et al. | 355/297 |
| 4,014,065 | 3/1977 | Hudson | 355/296 X |
| 4,040,383 | 8/1977 | Vandervort | 118/60 |
| 4,311,094 | 1/1982 | Ellison | 101/425 |
| 4,344,361 | 8/1982 | MacPhee et al. | 15/256.51 X |
| 4,704,963 | 11/1987 | Nishimura et al. | 101/425 |
| 4,789,432 | 12/1988 | Goodnow et al. | 162/281 |
| 4,875,412 | 10/1989 | Wright et al. | 101/425 |
| 4,972,780 | 11/1990 | Gasparrini et al. | 101/217 |
| 4,991,507 | 2/1991 | Nozaka et al. | 101/425 |
| 5,020,433 | 6/1991 | Jeschke et al. | 101/425 |
| 5,069,128 | 12/1991 | Hara et al. | 101/425 |
| 5,107,303 | 4/1992 | Miyamoto et al. | 355/296 |
| 5,125,342 | 6/1992 | Hara | 15/256.51 X |

FOREIGN PATENT DOCUMENTS

| | | | |
|---|---|---|---|
| 0119936 | 9/1979 | Japan | 355/297 |
| 0155380 | 12/1980 | Japan | 355/297 |
| 0015967 | 1/1984 | Japan | 355/297 |
| 0111673 | 6/1984 | Japan | 355/297 |
| 0193481 | 11/1984 | Japan | 355/297 |
| 0065474 | 3/1988 | Japan | 355/297 |

OTHER PUBLICATIONS

*IBM Technical Disclosure Bulletin*, vol. 17, No. 9, Feb. 1975, "Cleaning Station for Liquid Ink Development Unit", T. M. Paulson.

*Primary Examiner*—Matthew S. Smith
*Attorney, Agent, or Firm*—Nixon & Vanderhye

[57] ABSTRACT

Cleaning apparatus for an imaging cylinder in an ion deposition printer includes a housing having an upper portion and a lower portion, separated by an internal plate. The lower portion includes a plenum chamber having an opening at one end and a vacuum port at an opposite end, and a scraper blade mounted in the plenum chamber and having an edge engaging the imaging cylinder. A continuous cleaning web is mounted in the upper portion engaging the imaging cylinder downstream of the scraper blade. The cleaning web is impregnated with silicone oil. A related method includes the steps of a) engaging the peripheral surface of the imaging cylinder with a scraper blade to remove toner particles therefrom; and b) engaging the peripheral surface of the imaging cylinder downstream of the scraper blade with a continuous web impregnated with oil to remove residual toner particles and conductive powder deposits.

19 Claims, 1 Drawing Sheet

ION DEPOSITION PRINTER CLEANING APPARATUS AND RELATED METHOD

This invention relates to IDAX and MIDAX printing techniques and specifically, to a cleaning apparatus and method for an imaging cylinder utilized in such techniques.

BACKGROUND AND SUMMARY OF THE INVENTION

IDAX and MIDAX printing techniques are commercial electrographic imaging processes that utilize what is referred to as "silent electric discharge". In such systems, an ion cartridge is mounted adjacent an imaging drum. The drum then moves into contact with the transfer sheet (for example, paper). Conventional cartridges utilized in these printing systems include first and second electrodes, typically called the drive and control electrodes, separated by a solid dielectric member such as a sheet of mica. The control electrode, typically in the form of control fingers, defines an edge surface disposed opposite the driver electrode to define a discharge region at the junction of an edge surface in the solid dielectric member. An alternating potential is applied between the driver and control electrodes of sufficient magnitude to induce charged particle producing electrical discharges in the discharge region, and means are provided for applying a charged particle extraction potential between the control electrode and a further electrode, so that imaging occurs on the imaging drum, or paper or like dielectric moving past the ion cartridge. In most commercial installations, a screen electrode is also provided between the imaging drum and the control electrode, and separated by an insulating spacer from the control electrode. A commercial ion cartridge is typically constructed of a plurality of driver, control, and screen electrode units, in a matrix form. Conventional ion cartridges are disclosed in U.S. Pat. Nos. 4,155,093; 4,160,257; 4,267,556; and 4,381,327.

A toning station for supplying toner particles to the imaging cylinder is also provided to create a visible counterpart of the latent electrostatic image. Typically, a transfer roller is employed in rolling contact with the imaging cylinder under high pressure to transfer and simultaneously fuse the toner particles to a paper or other receptor sheet.

Laboratory and in-plant tests indicate the need for improved cleaning of the imaging cylinder and toner released to the paper within the print engine, particularly when color toners are employed. The primary problem relates to the presence of banded deposits around the imaging cylinder, the composition of which includes conductive powder that is attached to the toner particles to increase their electrical conductivity. This powder, a heavy metal tin/antimony oxide (known as T1), deposits itself in a very thin film on the surface of the imaging cylinder and is not removed by existing scraper and brush cleaning assemblies. The use of solvents has also proven ineffective against the deposited scum. It has been discovered that one effective way to clean the bands is by running hundreds of feet of plain paper through the machine to scour off the scum, but this is impractical in day-to-day operation.

This invention relates to a method and apparatus for solving the problem of scum deposits on the imaging cylinder. In the exemplary embodiment, the invention incorporates into an IDAX or MIDAX type machine the following components and/or manipulative steps: (1) A scraper blade with an improved swivel and spring mounting for better drum following and improved distribution of forces to assure a non-stressed flat loading on the scraper blade; (2) Direct air purging of the area around the scraper blade to assure removal of scraped powders; (3) A silicone impregnated, continuous cleaning web which is held tightly against the imaging cylinder (downstream of the scraper blade) with a resilient roller, spring loaded for better distribution of forces, driven at a slow rate in a direction counter to the direction of the imaging cylinder, and controlled in speed and tension with simple but effective mechanical controlling mechanisms; (4) A two-piece housing assembly, the bottom or lower portion of which serves as an assembly base and plenum chamber and carries the scraper and vacuum channels, while the top or upper portion carries the cleaning web, drive and tensioning assemblies.

In its broader aspects, therefore, the present invention provides cleaning apparatus for an imaging cylinder in an ion deposition printer comprising a scraper blade having an edge engaging the imaging cylinder; and a continuous cleaning web engaging the imaging cylinder downstream of the scraper blade, the cleaning web impregnated with silicone oil.

In another aspect, the present invention relates to a cleaning apparatus for an imaging cylinder in an ion deposition printer comprising a housing having an upper portion and a lower portion separated by an internal plate, the lower portion comprising a plenum chamber having an opening at one end and a vacuum port at an opposite end; a scraper blade mounted in the lower portion and having an edge engaging the imaging cylinder; and a continuous cleaning web mounted in said upper portion engaging the imaging cylinder downstream of the scraper blade, the cleaning web being impregnated with oil.

In still another aspect, the present invention relates to a method of cleaning toner and conductive powder deposits from an ion deposition printer imaging cylinder comprising the steps of:

a) engaging a peripheral surface of the imaging cylinder with a scraper blade to remove toner particles therefrom; and b) engaging the peripheral surface of the imaging cylinder downstream of the scraper blade with a continuous web impregnated with oil to remove residual toner particles and conductive powder deposits.

It has been found that the scraping blade removes most of the toner from the imaging cylinder, and that the silicone impregnated web scours and entrains the residual toner as it engages the imaging cylinder, thereby giving a cleaner performance to the remainder of the machine components. The web also scours and entrains separated heavy metal oxides present from the color toner formulation and thereby prevents the buildup of the conductive scum on the imaging cylinder which otherwise may cause premature image fading. The silicone oil from the web has been found to form a thin release layer which may assist in toner transfer to the paper while decreasing the amount of residual toner which could otherwise foul the system. The deposited silicone oil can also transfer to intermediate transfer members thus helping the transfer efficiency of the toner to the paper.

Other objects of the invention will become apparent from the detailed description which follows.

DETAILED DESCRIPTION OF THE DRAWINGS

Figure 1:
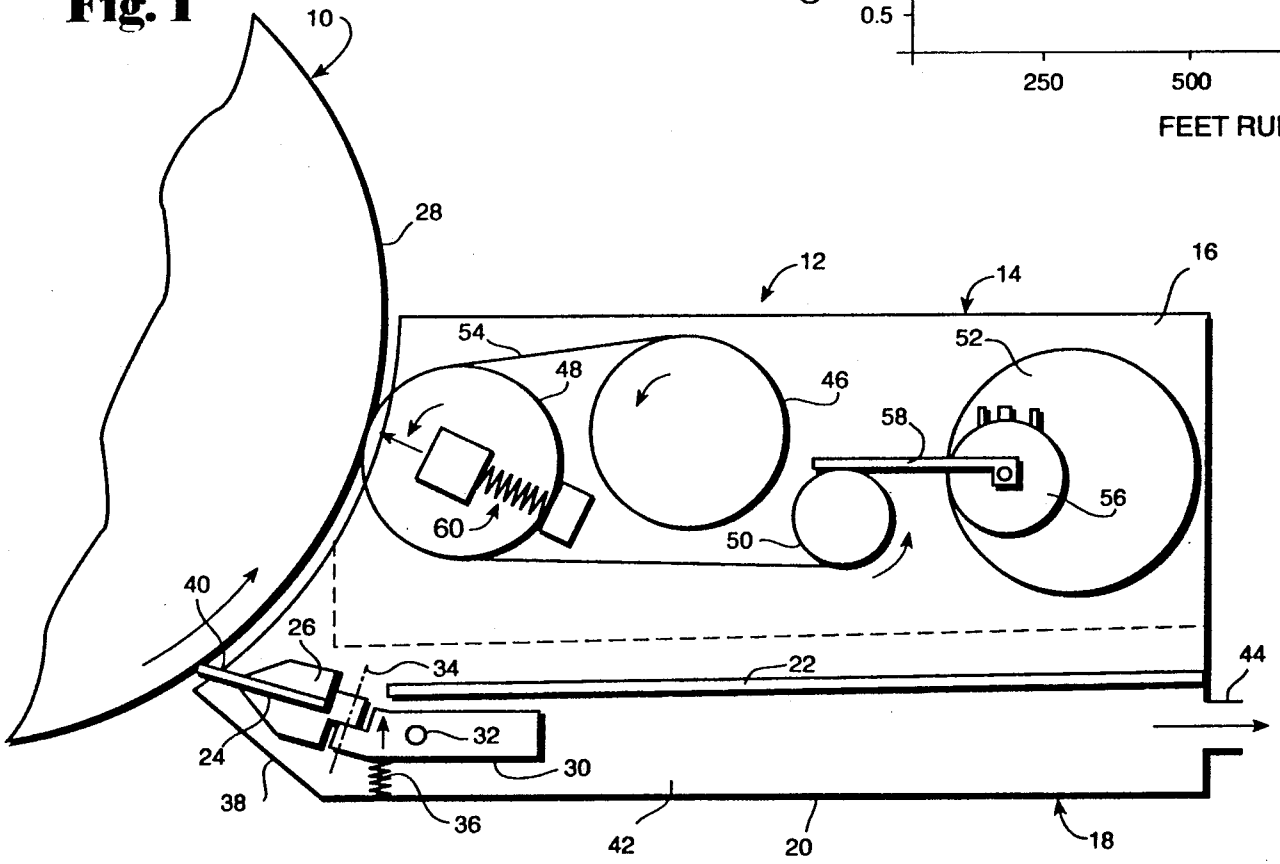
FIG. 1 is a side view of a cleaning apparatus in accordance with the invention.

The ion deposition cleaner apparatus in accordance with the exemplary embodiment of this invention is shown in FIG. 1. An image cylinder 10 of an ion deposition printer print engine is illustrated in part, adjacent a cleaner apparatus in accordance with this invention. The cleaning apparatus 12 includes a housing 14 which is formed to include an upper portion 16 and a lower portion 18. The lower portion is defined primarily by the lower housing wall 20 and a vacuum plate 22. The lower portion 18 encloses the scraping and vacuum devices, while the upper portion 16 encloses the cleaning web and its controlling apparatus, as described in greater detail below.

More specifically, within the lower housing portion 18, a steel scraping blade 24 is held flat within a clamp mount 26. To minimize stress on the blade, clamping within the clamp mount 26 is effected by spring loading a cradle 30 which is secured to the lower housing assembly 18 for pivotal movement about pivot pin 32. The clamp mount 26 is secured to the cradle 30 by means of a central pivot 34. By this arrangement, blade 24 is biased into engagement with the image cylinder surface 28 by forces exerted on cradle 30 by coil spring 36, while the pivot 34 allows the blade to lie flat against the imaging cylinder along the length of the cylinder.

It will be appreciated that the opening 40 in one end of the lower housing portion 18 by inclined portion 38 of the lower housing portion and the vacuum plate 22 permits toner scraped off the cylinder surface 28 to fall into the space or plenum chamber 42 between the vacuum plate 22 and the lower housing wall 20, and to then be carried away by an air flow created by a vacuum source acting through an outlet port 44 located in an opposite end of the lower portion.

The upper housing portion 16 holds the cleaning web assembly in a space above the vacuum plate 22. The cleaning web assembly includes a web supply drum or roll 46, an idler roller 48 (which protrudes through an opening in the upper housing portion) and a take up drum or roll 50 driven by a motor 52. A cleaning web 54, impregnated with silicone oil, extends from the supply roll 46, around the idler roll 48 and to the take up roll 50. The web 54 engages the image cylinder surface 28 as it traverses the idler roller, in a direction counter to the direction of the image cylinder 10.

The web 54 is positively pulled onto the take-up roll 50 by the motor 52 which is controlled in speed by a variable voltage divider network 56 which, in turn, is controlled by the variable diameter of the take-up roll pushing against the dancer bar 58 as the web 54 is wound onto the roll. Through a fixed gear train (not shown), the motor 52 is driven at variable speed, slowing down its rotational rate as the web 54 is wound onto the roll 50, thus insuring substantially constant linear speed of the web. The supply roll 46 may also be provided with a means (any suitable braking mechanism) for applying back tension to the idler roller 48. The idler roller 48 is preferably made with a rubber (neoprene or silicone) jacket and is spring loaded against the imaging cylinder 10 by any suitable means such as the spring assembly 60.

In use, the imaging cylinder surface 28 is first engaged by blade 24 which scrapes toner from the surface 28. The removed toner particles fall into the plenum chamber 42 and are removed through port 44 by an applied vacuum. The surface 28 is next engaged by the web 54 which is driven at a slow rate, such as about 0.001"/sec., in a direction counter to the direction of rotation of the image cylinder 10. The web 54 scours and entrains residual toner and heavy metal oxides continuously from the imaging cylinder surface 28, while constantly presenting a clean face to the cylinder 10.

Also attached to the cleaning assembly 12 is a warning device (not shown) to alert the operator to a low web condition vis-a-vis the supply roll 46. In the exemplary embodiment, the web is specified to last over 150 hours of operation, and need be discarded and replaced only at major overhaul intervals (about every 70 hours).

Use of the silicone impregnated idler roll 48 and cleaning web 54 in combination with the scraper blade/vacuum assembly as described above has been demonstrated to effect measurable improvements in system performance in the following respects:

(1) The scraper blade 24 has been found to remove 90+% of the toner from the imaging cylinder surface 28. At the same time, however, it has been found that the cleaning web 54 alone (with the scraper blade disabled), will remove nearly 100% of the toner. Nevertheless, the severe loading of toner on the web in the latter instance degraded the operation of the web driving and speed control mechanism. Thus, there are significant advantages to using both the scraper blade 24 and cleaning web 54 in the combination as disclosed herein.

(2) The cleaner web 54 in contact with the surface of the imaging cylinder 10 scours and entrains the residual toner not removed by the scraper blade. A further benefit is a cleaner performance of the remainder of the machine components (i.e., ion cartridge and erase rod).

(3) The cleaning web 54 in contact with the image cylinder surface 28 also scours and entrains the separated heavy metal oxides present from the color toner formulation. In other words, the silicone acts as a kind of "mechanical magnet" to capture and entrain toner particles and other loose T1 conductive powders which have become disassociated from the main magnetic color toner particles. This prevents the buildup of conductive scum on the imaging cylinder surface 28 and thus prevents premature image fading.

(4) The deposited silicone oil from the web forms a thin release layer on the cylinder surface 28 which enhances toner transfer to the paper, thus also decreasing the amount of residual toner which could otherwise foul the print engine. By lightening the load on the cleaning apparatus, the latter runs more efficiently.

(5) The thin silicone layer on the imaging cylinder surface 28 may also then transfer to intermediate transfer members (such as the low pressure offset roller). This in turn, may help the transfer efficiency of the toner to the paper and also help to replenish depleted oils from the surface of the intermediate transfer members.

(6) The use of spring loaded idler roller 48 maintains a high pressure loading of the impregnated web against the imaging cylinder surface 28 increases the cleaning action of the web. This action is necessary particularly when used with various blends of color toners which use the heavy metal oxide T1 conductive powders for enhancing the surface conductivity of the toner. Experiments have demonstrated that disassociation of the T1 powder from the toner and the subsequent coating of the imaging cylinder with the T1 creates bands of higher conductivity around the imaging cylinder which in turn causes almost immediate image optical density degradation as illustrated in FIG. 2.

Figure 2:
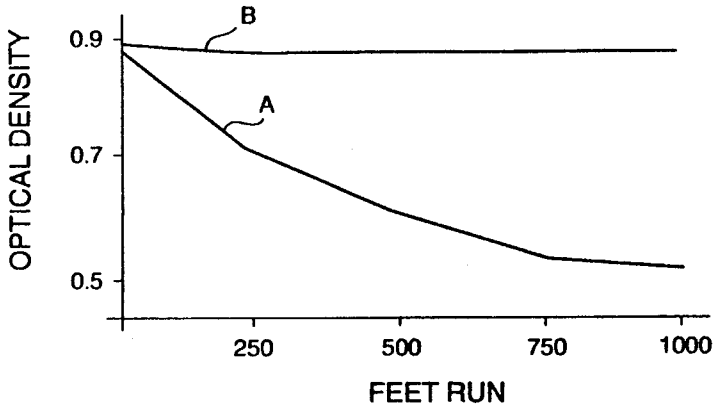
FIG. 2 is a graph illustrating blue light optical density as a function of imaged product length with and without the web cleaner of this invention.

FIG. 2 illustrates blue light optical density against imaged product length with and without the web cleaner of this invention. Curve A (without the cleaner apparatus of this invention) shows the image density dropping to an unacceptable density level with only a few hundred feet of operation. The degradation of surface density was caused by the increased surface conductivity in the bands of coated T1 which blurred or defocused the charged latent image being produced by the print cartridge. Use of the web cleaner in accordance with this invention, with the high peak loading at the point of the imaging cylinder contact and with the silicone oil impregnation of the web, causes a vigorous cleaning action and creates a better surface release of the conductive powder to allow indefinite operation of the system with no loss in image quality, as shown by curve B.

(7) Production tests have also shown the efficiency of the web cleaning station to approach 100%. Moreover, comparison of trial batches of ion cartridges have shown the web cleaning system enhances the virgin print cartridge life to the level of cartridges run on the bench in the laboratory with no toner or paper dust to contaminate it.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Cleaning apparatus for an imaging cylinder in an ion deposition printer wherein toner particles are supplied to the imaging cylinder and thereafter transferred to a receptor sheet comprising:

a scraper blade having an edge engaging the imaging cylinder; and a continuous cleaning web means engaging the imaging cylinder downstream of the scraper blade, the cleaning web means impregnated with silicone oil and arranged for applying a film of silicone oil to said imaging cylinder forming a release layer thereon which facilitates transfer of the toner particles to the receptor sheet.

2. The apparatus of claim 1 wherein said continuous web means is drawn from a supply drum and wound on a take-up drum, and wherein an idler roller is located between the supply drum and take-up drum in the path of movement of the web, the idler roller located to cause the continuous web to engage the imaging cylinder.

3. The apparatus of claim 2 wherein said idler roller is spring biased towards said imaging cylinder.

4. The apparatus of claim 2 wherein said take-up roll is driven by a motor and wherein the speed of the take-up roller is a function of the diameter of the take-up roller and continuous web wound thereon.

5. The apparatus of claim 1 wherein said scraper blade is mounted within a plenum chamber connected to a vacuum source.

6. The apparatus of claim 1 wherein said scraper blade is spring biased into engagement with the imaging cylinder.

7. The apparatus of claim 1 wherein said scraper blade is mounted for movement about two axes.

8. The apparatus of claim 1 and further including a housing formed in two sections, an upper section enclosing the continuous cleaning web means and a lower section enclosing the scraper blade.

9. Cleaning apparatus for an imaging cylinder in an ion deposition printer wherein toner particles are supplied to the imaging cylinder and thereafter transferred to a receptor sheet comprising;

a scraper blade having an edge engaging the imaging cylinder; and a continuous cleaning web engaging the imaging cylinder downstream of the scraper blade, the cleaning web impregnated with silicone oil;

wherein said continuous web is drawn from a supply drum and wound on a take-up drum, and wherein an idler roller is located between the supply drum and take-up drum in the path of movement of the web, the idler roller located to cause the continuous web to engage the imaging cylinder, said take-up drum being driven by a motor, and the speed of said take-up drum being a function of the diameter of the take-up roller and continuous web wound thereon;

and further wherein a dancer bar extends between the motor and the take-up drum to control the speed of the motor.

10. Cleaning apparatus for an imaging cylinder in an ion deposition printer wherein toner particles are supplied to the imaging cylinder and thereafter transferred to a receptor sheet comprising:

a housing having an upper portion and a lower portion separated by an internal plate, the lower portion comprising a plenum chamber having an opening at one end and a vacuum port at an opposite end;

a scraper blade mounted in said lower portion and having an edge engaging the imaging cylinder; and a continuous cleaning web means mounted in said upper portion engaging the imaging cylinder downstream of the scraper blade, the cleaning web means being impregnated with silicone oil and arranged for applying a film of silicone oil to said imaging cylinder forming a release layer thereon which facilitates transfer of the toner particles to the receptor sheet.

11. The apparatus of claim 10 wherein said continuous web means is drawn from a supply drum and wound on a take-up drum, and wherein an idler roller is located between the supply drum and take-up drum in the path of movement of the web, the idler roller located to cause the continuous web to engage the imaging cylinder.

12. The apparatus of claim 11 wherein said idler roller is spring biased towards said imaging cylinder.

13. The apparatus of claim 11 wherein said take-up roll is driven by a motor and wherein the speed of the take-up roller is a function of the diameter of the take-up roller and continuous web means wound thereon.

14. The apparatus of claim 10 wherein said scraper blade is spring biased into engagement with the imaging cylinder.

15. The apparatus of claim 10 wherein said scraper blade is mounted for movement about two axes.

16. Cleaning apparatus for an imaging cylinder in an ion deposition printer wherein toner particles are supplied to the imaging cylinder and thereafter transferred to a receptor sheet comprising;

a housing having an upper portion and a lower portion separated by an internal plate, the lower portion comprising a plenum chamber having an opening at one end and a vacuum port at an opposite end;

a scraper blade mounted in said lower portion and having an edge engaging the imaging cylinder; and a continuous cleaning web mounted in said upper portion engaging the imaging cylinder downstream of the scraper blade, the cleaning web being impregnated with silicone oil;

wherein said continuous web is drawn from a supply drum and wound on a take-up drum, and wherein an idler roller is located between the supply drum and take-up drum in the path of movement of the web, the idler roller located to cause the continuous web to engage the imaging cylinder, said take-up drum being driven by a motor, and the speed of the take-up drum being a function of the diameter of the take-up roller and continuous web wound thereon; and further wherein a dancer bar extends between the motor and the take-up drum, so that the speed of the moor is a function of the diameter of the take-up drum.

17. A method of cleaning toner and conductive powder deposits from an imaging cylinder in an ion deposition printer wherein toner particles are supplied to the imaging cylinder and thereafter transferred to a receptor sheet, the method comprising the steps of:

a) engaging a peripheral surface of the imaging cylinder with a scraper blade to remove toner particles therefrom; and b) engaging the peripheral surface of the imaging cylinder downstream of the scraper blade with a continuous web impregnated with silicone oil to remove residual toner particles and conductive powder deposits, and to provide a release layer on the peripheral surface of the imaging cylinder to enhance toner transfer to the receptor sheet.

18. The method of claim 17 wherein, during step b), the continuous web is biased into engagement with the peripheral surface of the imaging cylinder.

19. The method of claim 17 wherein, in the practice of step a) the toner particles are carried away by a vacuum.

* * * * *